US006860065B2

(12) United States Patent
Griffin et al.

(10) Patent No.: US 6,860,065 B2
(45) Date of Patent: Mar. 1, 2005

(54) REMOTE RELEASE FOR A MOVABLE BARRIER ARRANGEMENT

(75) Inventors: James C. Griffin, Glen Ellen, IL (US); James J. Fitzgibbon, Batavia, IL (US); Edward T. Laird, Lombard, IL (US); Robert J. Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/141,283

(22) Filed: May 8, 2002

(65) Prior Publication Data

US 2003/0208961 A1 Nov. 13, 2003

(51) Int. Cl.[7] ..... E05F 15/00
(52) U.S. Cl. ..... 49/139; 49/25
(58) Field of Search ..... 49/139, 140, 197, 49/199, 25

(56) References Cited

U.S. PATENT DOCUMENTS

| | | | | | |
|---|---|---|---|---|---|
| 3,785,089 | A | * | 1/1974 | Smith | 49/139 |
| 4,905,542 | A | | 3/1990 | Burm et al. | |
| 5,176,582 | A | | 1/1993 | Chang et al. | |
| 5,222,327 | A | * | 6/1993 | Fellows et al. | 49/139 |
| 5,278,480 | A | * | 1/1994 | Murray | 318/626 |
| 5,297,782 | A | | 3/1994 | Dombrowski et al. | |
| 5,422,552 | A | * | 6/1995 | Parisi | 318/466 |
| 5,557,887 | A | * | 9/1996 | Fellows et al. | 49/28 |
| 5,903,226 | A | * | 5/1999 | Suman et al. | 340/825.69 |
| 5,969,637 | A | * | 10/1999 | Doppelt et al. | 340/825.69 |

* cited by examiner

*Primary Examiner*—Jerry Redman
(74) *Attorney, Agent, or Firm*—Fitch, Even, Tabin & Flannery

(57) ABSTRACT

A system for decoupling a barrier from a barrier movement apparatus for the manual operation of the barrier. Advantageously, the decoupling is performed in response to a wireless signal and may be done only when the barrier is determined to be in a safe position.

15 Claims, 5 Drawing Sheets

REMOTE RELEASE FOR A MOVABLE BARRIER ARRANGEMENT

The present invention relates to barrier movement systems and particularly to security methods and arrangements for such systems.

Barrier movement systems generally include an electric motor which is coupled to the barrier and selectively powered by a controller to move a barrier between open and closed positions. When the barrier is coupled to the motor the coupling and the motor may be an impediment to the manual movement of the barrier. Should an intruder attempt to force a barrier open, such impediment is beneficial as it will usually stop the intrusion. However, when a permitted user desires to manually move the barrier the impediment may be a hardship. For example, when the source of electrical power which drives the motor is lost e.g., a power outage, then a permitted user may not be able to "back drive" the barrier movement system to gain entry to the secure area beyond the barrier.

Modern barrier movement systems include a mechanical apparatus for uncoupling parts of the barrier movement system from the barrier to be moved. These uncoupling systems frequently include a mechanical connection to some point along the connection between the motor and the barrier which mechanically decouples the connection. A common such decoupling arrangement includes a flexible member such as a rope or cable which is connected to a portion of the drive mechanism. When the flexible member is pulled a mechanical release is enabled which separates the connection between the motor and the barrier. Access to the decoupling apparatus must be limited or an intruder could easily enter a secure area by pulling the flexible member. Accordingly, the flexible member is available only to persons already inside the secure area or only to persons who can unlock a more publically available end of the flexible member. A need exists for an improved arrangement to allow a permitted person outside a secure area to disconnect the physical connection between a barrier and its driving apparatus to allow manual movement of the barrier.

SUMMARY

The present invention relates to remote barrier release arrangement responsive to a transmitted signal, such as an rf, sound, or optical signal, for decoupling the motor and the barrier for movement by a user. Advantageously, the remote release arrangement may include a power supply separate from that which powers the motor to power the operation of the remote release in case a primary power supply is interrupted.

In an embodiment the arrangement includes an electrical clutch which connects the motor to the barrier. Advantageously, the clutch is connected on the barrier side of any gear reduction to minimize the back forces required for a user to move the barrier. Such a clutch arrangement may be used on either a jack shaft type barrier movement system or a trolley-rail type.

Another embodiment includes a trolley-rail release system in which a trolley, driven by a motor to move a barrier may be decoupled from the motor in response to a transmitted signal. Advantageously, the decoupling of the trolley is accomplished using parts of a manual release system. The trolley decoupling system includes an auxiliary power supply to enable operation when mains power is lost.

A programmable controller is employed to enable the remote release arrangement disclosed herein. Advantageously, the arrangement also includes software or apparatus for determining the position of the barrier. The controller consults the barrier position before allowing release of the barrier so that the barrier may be released only when in a safe position for such release. For example, the controller may permit remote release of the barrier only when the barrier is within 6 inches of the closed position.

BRIEF DESCRIPTION OF THE DRAWING

The following description may be more readily understood when read in conjunction with the drawing in which.

DESCRIPTION

The embodiments described herein concern the vertical movement of a garage door. It can readily be seen that the arrangements described and claimed herein also apply to other types of barriers and other types of motion. For example, the present invention is equally applicable to automated swinging barriers or horizontally sliding barriers and other types of automated barrier movement systems.

Figure 1:
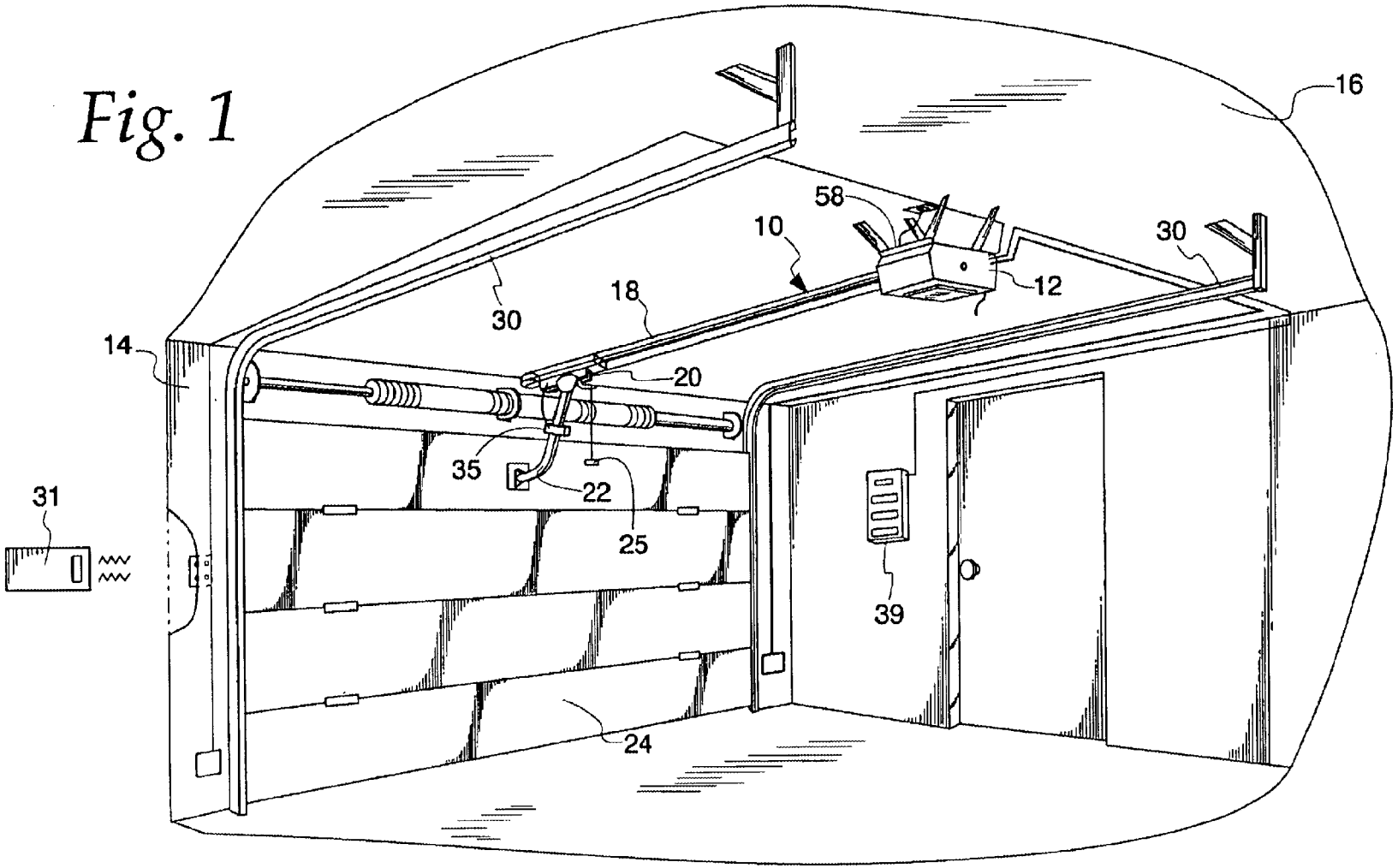
FIG. 1 is a perspective view of an assembled rail-trolley type barrier movement arrangement.

FIG. 1 shows an automated arrangement 10 for vertically moving a paneled door 24 along a set of guide rails 30 between a closed position as shown and an open position in which door 24 is held is a substantially horizontal position by an upper portion of rails 30. The arrangement 10 includes a head end housing 12 which includes the items in FIG. 2, a motor 50, an rf receiver 52 with antenna 54 and a controller 56. A source of mains voltage 58 is connected to controller 56 which selectively distributes power to the individual units of FIG. 2 as needed. The mains voltage may be the standard 110V 60 HZ household power available in the U.S. from the power grid. The controller 56 responds to rf signals from user operated transmitter 31 (FIG. 1) via receiver 52, by selectively coupling mains power from source 58 to the motor 50. An output shaft 60 of the motor 50 is then rotated clockwise or counter-clockwise depending on the output of controller 56. By means well known in the art a chain couples the shaft 60 to a trolley 20 which moves linearly along a rail 18 under the motor's power. The trolley is in turn coupled by a lever on 22 to a top portion of the door 24. Trolley 20 consists of an outer portion 21 and an inner portion 23. As is known in the art the door 24 can be released from the motor 50 by pulling downward on a rope 25 which controls a mechanical latch between inner portion 23 and outer portion 21 of trolley 20.

Figure 3:
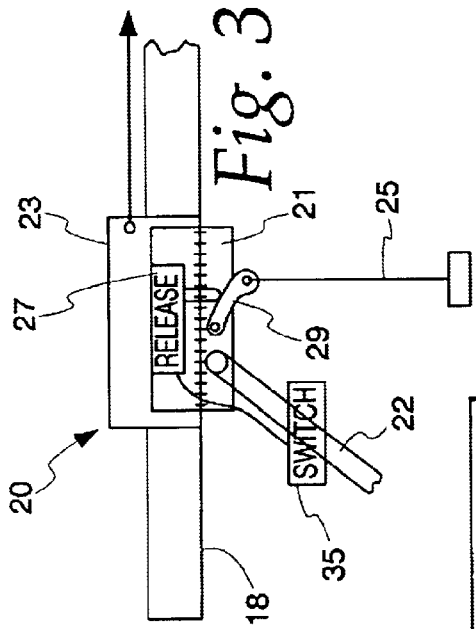
FIG. 3 is a mechanical block diagram of a trolley including a remote release mechanism.

FIG. 3 represents the trolley 20 in greater detail. Trolley 20 consists of inner portion 23 and outer portion 21 which can be unlatched by moving a lever arm 29 downwardly.

Figure 4:
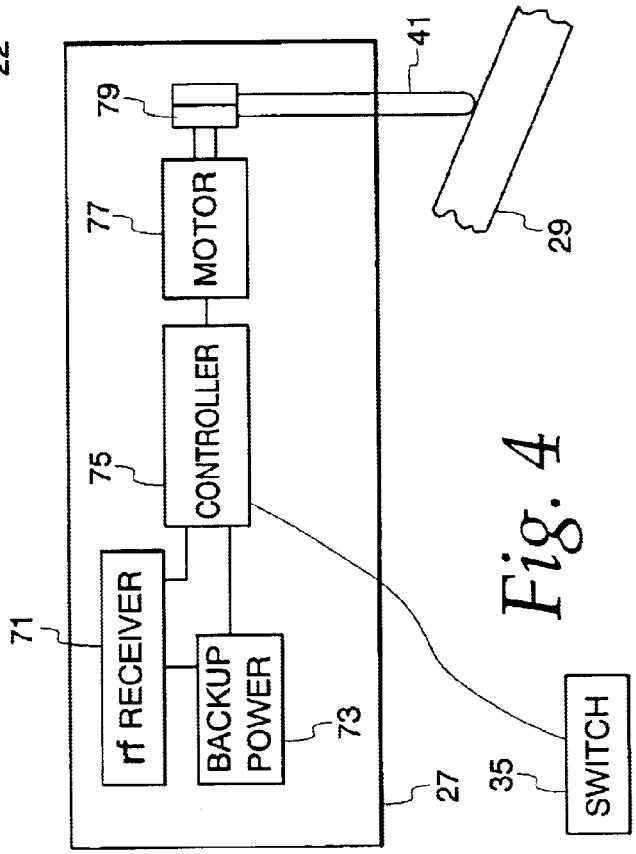
FIG. 4 is a block diagram of a controller of the release mechanism of FIG. 3.

When rope 25 is pulled downwardly outer portion 21 is released to slide horizontally along rail 18 without having to drive the motor 50 or its connection to trolley 20 in any way. Trolley 20 of the present embodiment also includes a release unit 27 which is shown in block diagram form in FIG. 4. Release unit 27 includes a back-up power source 73 such as a battery, and rf receiver 71, a controller 75, a motor 77 and a coupling 79 between motor 77 and release lever 29. Rf receiver 71 detects received transmissions and sends detected signals to controller 75 which decodes the detected signals to identify a request for release of the door. In the present embodiment controller 75 has been taught to recognize a signal initiated by one of the transmit buttons of a remote transmitter such as transmitter 31. Controller 75 also checks the condition of a switch 35 for safety purposes. Switch 35 may be, for example, a tilt switch attached to connector 22 (FIG. 1) which presents a closed circuit when the angle of connector 22 indicates that the door 24 is within 6 inches of being closed. When controller 75 senses a recognized received rf signal and that the door is in a safe position within 6 inches of being closed, power from backup power 23 is connected to motor 77 which responds thereto by urging release lever downwardly to unlatch the inner portion 23 and outer portion 21 of trolley 20. The above-described embodiment allow a user to approach the door from outside the secure area and by pressing a particular transmit button on his or her remote transmitter, releasing the door for manual operation. Such is found to be most beneficial when the automatic opening provided by head end 12 is unavailable due to an interruption of mains power.

In the preceding embodiment the door position sensing switch 35 is described as connected to the lever arm 22. In other embodiments the switch 35 might be attached to the door, or to the non-moving structure of the door supports or garage. The function of switch 35, to indicate a safe door position for release operation, may be performed by many types of door sensing or switch placement. The position sensing could also be reported from the controller 56 which knows the position of the trolley as a part of its movement control function. Also the preceding embodiments show a motor 77 to disengage the trolley. Other electrically powered for such disengagement are also contemplated. For example, an electrical solenoid could be connected to the back up power source 73 to achieve such disengagement.

Figure 5:
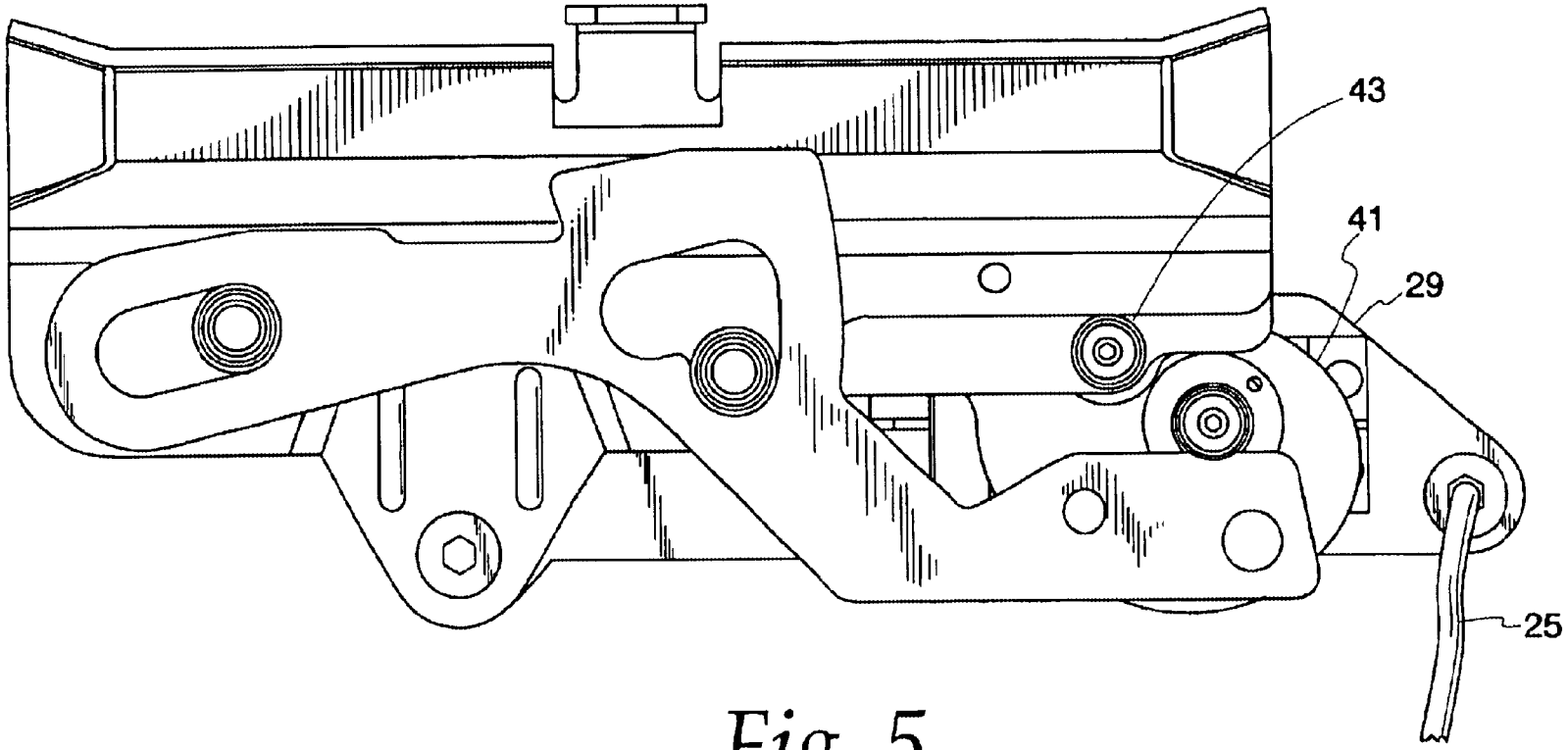
FIG. 5 is a plan view of a barrier movement trolley in the connected state.
Figure 6:
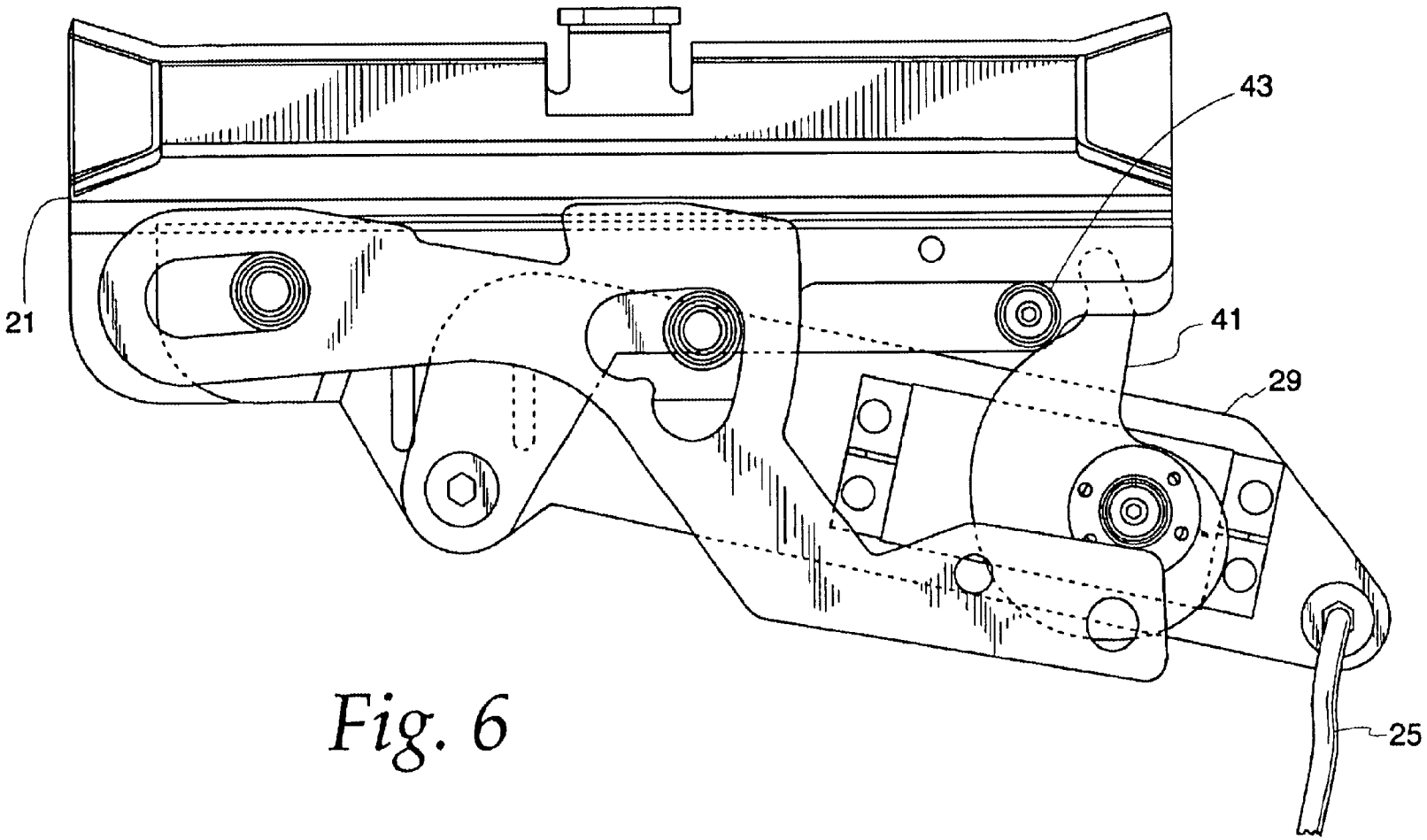
FIG. 6 is a plan view of the barrier movement trolley in the released state.

FIGS. 5 and 6 depict the mechanical structure of a preferred embodiment of trolley 20 in the idle (connected) and active (released) modes, respectively. Trolley motor 77 is connected via substantial gear reduction (not shown) to rotate a cam 41 which is attached to release lever 29. Cam 41 engages a roller 43 of the trolley 20. When the trolley motor 77 is powered by controller 75 it rotates cam 41 in the counter clockwise direction in FIGS. 5 and 6. Due to the shape of cam 41 this forces lever 29 downward in a manner similar to the movement of lever 29 in response to a manual pull on rope 25. When cam 41 has rotated from the position of FIG. 5 to that of FIG. 6 the inner portion 23 and outer portion 21 of trolley 20 are released and the door can be moved without back driving the motor. At the completion of release, the cam 41 can be manually rotated into the at-rest position of FIG. 5, a spring (not shown) may be attached to cause the return rotation to the original state or the polarity of back up power to motor 77 reversed to rotate cam 41 in the clockwise direction.

Figure 7:
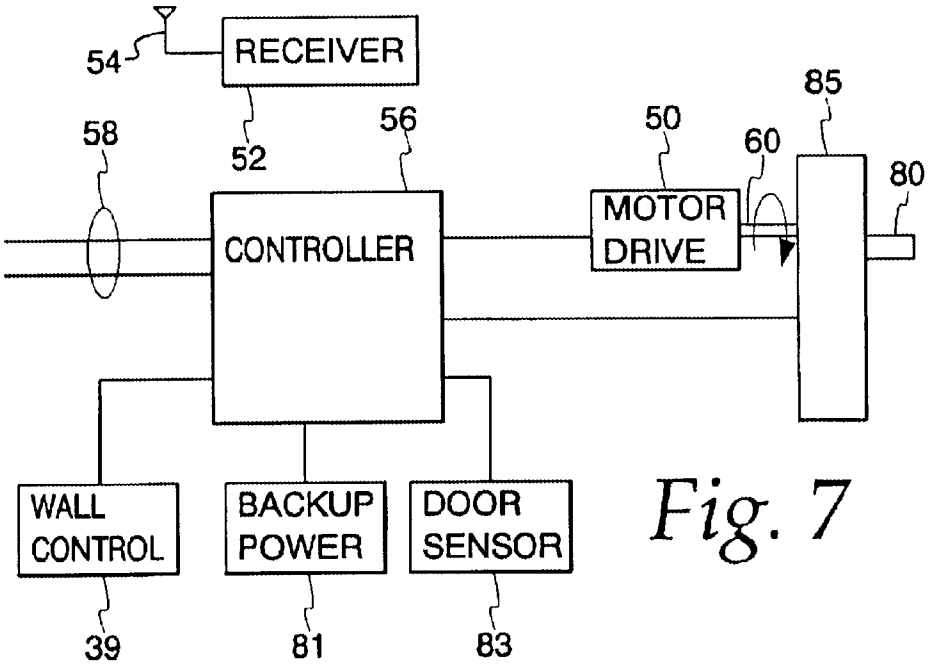
FIG. 7 is a block diagram of an alternative embodiment for an electric clutch release arrangement.

Also in the preceding embodiment the release of the door for manual operation was performed on the linearly moving trolley 20. The release of the door may also be obtained by an electric clutch in the output of motor drive 50. FIG. 7 represents such a clutch actuating arrangement which is a part of the head end 12.

Figure 2:
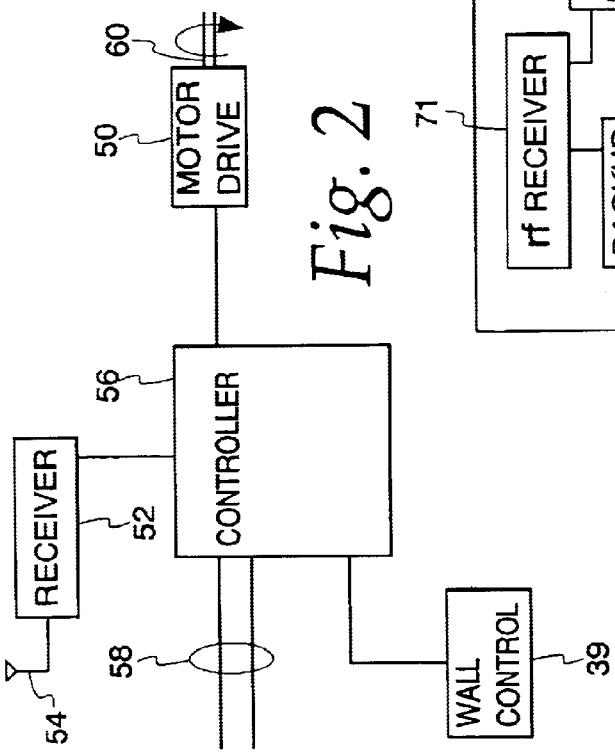
FIG. 2 is a block diagram of portions of the controller and related apparatus.

In FIG. 7, components having the same element number as in FIG. 2 are substantially the same as in FIG. 2 except as described herein. An electric clutch 85 is connected between the output shaft 60 of motor 50 and an output shaft 80 of the electric clutch drives the previously described sprocket and chain. The controller 56 is also connected to a backup power source 81 which may, for example, be a rechargeable battery. Also shown connected to controller 56 is a door sensor 83 to sense the position of door 24. Because controller 56 is at all times in control of door movement it may keep a constant second of door position, in which case the door sensor 83 may be unneeded. Receiver 82 receives wireless transmissions and conveys detected signals to controller 56. When detected signals are received which represent a wireless disconnect signal controller 56 checks the position of the door 24. When the position is determined to be safe, power is applied to electric clutch 85 to release output shaft 80 from motor shaft 60. In this way the door is manually movable without back driving motor 50 and any associated gearing.

In cases where mains power has been interrupted the embodiment of FIG. 7 powers the circuitry shown (except motor 50) from back up power 81. In this way the door can be released from the drive system when mains power interruption has occurred.

Figure 8:
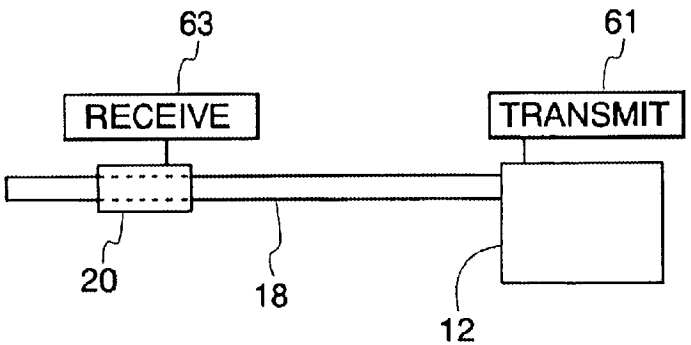
FIG. 8 shows an alternative embodiment for enabling a trolley release.

FIG. 8 shows an additional embodiment in which door release decisions are made by the controller in the head end 12 and implemented at the trolley 20. Upon making a decision to release the door controller 56 (FIG. 7) sends a signal to a transmitter 61 for transmission to a receiver 63 of the trolley 20. Although the transmitted signal is preferred to be sent by wireless means such as rf, sound, or optics such could also be conveyed by a wire path. Receiver 63 forwards the received signal to controller 75 of the trolley 20 which responds thereto by connecting back up power 73 to motor 77. As previously discussed, rotation of the shaft of motor 77 will release the inner and outer portions of trolley 20.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. A barrier movement system comprising:

a motor selectively connected to a first source of electrical power;

a movable trolley assembly connected to the motor and to a barrier to couple the force generated by the motor to the barrier for movement thereof;

the movable trolley assembly comprising a receiver receiving transmitted release signals and a release arrangement responsive to a transmitted release signal decoupling the barrier from the motor, and the release arrangement includes a second source of electrical power not dependent upon the presence of the first source of electrical power.

2. A barrier movement system in accordance with claim 1 comprising position indicating apparatus for generating position signals representing the position of the barrier.

3. A barrier movement system in accordance with claim 2 wherein the release arrangement responds to the position signals.

4. A barrier movement system in accordance with claim 3 wherein the release arrangement responds to the position signals and decouples the barrier from the motor when the barrier is in a safe position.

5. A barrier movement system in accordance with claim 2 comprising a controller for selectively connecting the motor to the first source of electrical power.

6. A barrier movement system in accordance with claim 5 the controller is a programmable platform, programmed to generate the position signals.

7. A barrier movement system in accordance with claim 5 wherein the controller transmits the release signal.

8. A barrier movement system in accordance with claim 2 wherein the position indicating apparatus comprises a switch responsive to a position of the door.

9. A barrier movement system in accordance with claim 2 wherein the position indicating apparatus comprises a tilt indicating switch.

10. A barrier movement system in accordance with claim 2 wherein the position indicating apparatus comprises a tilt switch attached to the door.

11. A barrier movement system in accordance with claim 2 wherein the position indicating apparatus is attached to a connection between the motor and the barrier.

12. A barrier movement system in accordance with claim 11 wherein the movable trolley assembly includes a linearly moving connection between the barrier and the motor.

13. A barrier movement system in accordance with claim 1 wherein the movable trolley assembly comprises a linearly moving connection between the barrier and the motor.

14. A barrier movement system in accordance with claim 13 wherein the release arrangement comprises apparatus for decoupling the barrier from the linearly moving connection.

15. A barrier movement system in accordance with claim 1 wherein the release signal is transmitted by a wireless transmitter controlled by a user.

* * * * *